United States Patent [19]

Kober

[11] Patent Number: 4,605,568

[45] Date of Patent: Aug. 12, 1986

[54] APPLICATION OF FOAM TO IMPROVE FLOW CHARACTERISTICS OF WATER-INSOLUBLE PRODUCTS

[75] Inventor: Alfred E. Kober, Bridgewater, N.J.

[73] Assignee: Apollo Technologies Int'l Corp., Morris Plains, N.J.

[21] Appl. No.: 729,804

[22] Filed: May 2, 1985

[51] Int. Cl.[4] ..... B05D 7/00; C09K 3/00

[52] U.S. Cl. ..... 427/220; 44/6; 252/384; 427/212

[58] Field of Search ..... 44/6; 252/384; 427/212, 427/220

[56] References Cited

U.S. PATENT DOCUMENTS

| | | | |
|---|---|---|---|
| 3,734,834 | 5/1973 | Bricmont | 201/39 |
| 3,757,491 | 9/1973 | Gourdine | 55/107 |
| 3,811,247 | 5/1974 | Huppke | 55/178 |
| 3,937,283 | 2/1976 | Blauer et al. | 166/307 |
| 3,954,662 | 5/1976 | Salyer et al. | 252/382 |
| 4,000,992 | 1/1977 | Cole | 55/87 |
| 4,200,413 | 4/1980 | Fitch | 406/49 |
| 4,342,797 | 8/1982 | Kober et al. | 427/220 |
| 4,400,220 | 8/1983 | Cole | 134/18 |

FOREIGN PATENT DOCUMENTS

| | | |
|---|---|---|
| 435351 | 9/1935 | United Kingdom . |
| 602406 | 5/1948 | United Kingdom . |

*Primary Examiner*—Michael R. Lusignan

*Attorney, Agent, or Firm*—James & Franklin

[57] ABSTRACT

The flow characteristics of a mass of wet, water-insoluble solid particles such as coal are improved by applying thereto a flow-characteristic-improving substance in the form of a foam.

15 Claims, No Drawings

APPLICATION OF FOAM TO IMPROVE FLOW CHARACTERISTICS OF WATER-INSOLUBLE PRODUCTS

This invention relates to a method of improving the flow characteristics of wet water-insoluble particles by applying thereto a flow aid substance in the form of a foam.

There are many industrial applications where masses of water-insoluble solid particles must be moved from one place to another. This often involves causing the particles to flow through narrowed or otherwise restricted openings. The particles when dry flow quite readily, but when they are dampened or wet they tend to agglomerate and to adhere to the surfaces of the openings through which the mass of particles must pass, thus restricting their readiness of flow and often causing actual blockages in the flow path, which require an interruption of the industrial process in order to clear the blockage. Such an interruption, of course, is a clear economic loss, and even diminution of the rate of flow of the particles can be very deleterious. For example, since very substantial quantities of coal particles are required by public utility installations, the coal is generally stored out of doors in an unprotected fashion, the coal therefore being exposed to rain or snow. In the course of generating electrical power from the combustion of such coal particles, if the coal particles tend to flow into the furnace at an insufficient rate the amount of power that can be produced is limited. Since electric utility installations must be capable of providing maximum power during periods of maximum power consumption, limitation of maximum power if the coal used is dampened or wet presents a very serious problem which, if not overcome, requires an investment in excessive amounts of capital equipment to provide adequate coal feed at all times.

This problem has long been recognized as a serious one, and attempts have been made to minimize the adverse effects of moisture on the flow characteristics of particles of coal or similar water-insoluble materials. One such approach has been to apply to the coal particles a substance known to have the effect of improving the flow characteristics of the coal (hereinafter, when reference is made to coal, it will be understood that that reference also includes other water-insoluble particulate substances). Certain substances having surfactant characteristics have been proposed for this purpose. My U.S. Pat. No. 4,342,797 of Aug. 3, 1982 entitled "Wet Flow Characteristics of Coal and Other Water-Insoluble Solid Particles" relates to this approach to the problem and, in its introductory paragraphs, describes in some detail the nature of the problem, and the disclosure of that patent is here incorporated by reference to set forth the nature of the problem and what was, up to the present invention, thought to be the best solution to the problem. Such substances are generally applied in the field as an aqueous spray at a coal belt transfer point, because the coal passes that point with its maximum surface area exposed so that optimum contact with the additive aqueous spray is obtained. An alternative method of treating coal with flow improving substances in laboratory studies has been to mix, by agitation, the coal particles with the aqueous surfactant mixture.

Another, and quite different, problem which arises in connection with the industrial use of particles of coal is that those particles, either initially or by a process of attrition, become dust-like in size. Those dust particles tend to fly into the air as the coal is transported, not only constituting a nuisance but also representing a substantial loss in operative material, and such loss also occurs simply through the action of wind on an exposed stationary pile of coal. The art has ameliorated that problem by dampening the coal. The wetted dust particles no longer fly about. In order to apply the water to the coal dust particles, it has been proposed to apply the water to the masses or piles of coal in the form of a foam. Cole U.S. Pat. No. 4,400,220 of Aug. 23, 1983 entitled "Suppression of Respirable Dust With Foam" describes such an approach, and in particular teaches the use of foam of very small bubbles, those bubbles engaging and being burst by the dust particles, thereby to wet the dust particles. Another patent relating to the use of foam to suppress coal dust is Salyer et al. U.S. Pat. No. 3,954,662 of May 4, 1976 entitled "Aqueous Foam Compositions to Suppress Coal Dust". It is to be stressed that the dust-suppressing foams have water as the active dust suppressant, and the function of the foaming agents mixed with the water in order to produce the foam was solely to increase the effective surface area of the water, thereby to more efficiently wet the dust particles. The foaming agents themselves were not the active ingredients.

I have discovered that if one takes substances which, when applied to coal particles in liquid or aqueous form, enhance the flow characteristics of those particles (such substances, for example, being those disclosed in my U.S. Pat. No. 3,432,797) and applies those substances in the form of a foam, their flow-improving characteristics are significantly enhanced. This result was to me quite unexpected and surprising, since the prior art uses of foam in connection with coal particles had been to wet those particles, and increased wetting, for coal particles already tending to clog because of dampness, is therefore contra-indicated.

The prime object of the present invention is to provide a method for the treatment of water-insoluble solid particles so as to improve their flow characteristics when wet beyond what has previously been thought feasible.

A correlative object of the present invention is to devise such a method which is economically feasible, which employs minimal amounts of active ingredient, and in particular substantially lesser amounts than had previously been used.

To those ends, and in accordance with the present invention, the water-insoluble particles in question, either when they are in a pile or, preferably, while they are being transported to a storage hopper or silo from which they must flow readily, are treated with a foam of a substance which has the property of improving the wet flow characteristic of those particles, that substance preferably being a readily water-soluble substance having the property of lowering surface tension in aqueous solution and the foam then being an aqueous foam. The application of this foam to the particles prevents caking and causes the particles to slide readily over one another and over the surfaces of the enclosure in which they may be contained even when the particles are quite wet, the flow improvement being markedly greater than if the active substances were to be applied in an unfoamed condition. As a result, the particles will flow efficiently and effectively despite the presence of an appreciable amount of water.

To the accomplishment of the above, and to such other objects as may hereinafter appear, the present invention relates to a method of inhibiting the caking tendencies and improving the wet flow characteristic of water-insoluble solid particles, as defined in the appended claims and as described in this specification.

The active substances used in accordance with the present invention, which have the property of improving the flow characteristics of said particles when applied in a non-foamed condition, are usually surfactants. The term "surfactant" is here used to mean a substance having the property of lowering surface tension in aqueous solution. Particulated bituminous and lignite coals are the water-insoluble materials to which the tests set forth in this specification are specifically directed, but it will be understood that they are but typical of water-insoluble particles as a class. For example, the instant invention is quite applicable to the treatment of pulverized ores of various compositions.

In order to determine the ameliorative effects of selected surfactants in foamed condition when used in connection with coal particles, and to compare the effects of such substances when foamed and not foamed, coal was delivered by a volumetric auger-type solids feeder onto an inclined metal plate where it was spread into a uniform flat stream and then allowed to drop into a container, and as the coal dropped a solution of appropriate active material, sometimes as a spray and sometimes as a foam, was applied to it, thereby to simulate normal field application at a belt transfer point. The coal was pre-dried and then treated with moisture prior to the above-described procedure in order to bring the moisture level of the coal to a desired value and the final surface moisture content in each case was verified by direct measurement with a Speedy Moisture Tester. Shear tests on the thus-treated coal were carried out as set forth in the first three paragraphs of column 4 of my U.S. Pat. No. 4,342,797, except that a bucket was used instead of a weight platform, water was added to the bucket gradually, and after the top part of the cell was pushed off of the bottom the bucket and water was weighed to determine the force applied at the shear point.

Table I shows shear test data for untreated coal at various percents of surface moisture, the tests being run on uniform samples of bituminous coal sized to −4 mesh.

TABLE I

BASELINE SHEAR TEST DATA[1]

| Total % Moisture | Shear Strength, g Bituminous | Shear Strength, g Lignite |
|---|---|---|
| air dried | 278 | 258 |
| 6.9 | 417 | — |
| 7.1 | 420 | — |
| 7.4 | 426 | — |
| 8.1 | 438 | — |
| 24.9 | — | 351 |
| 28.2 | — | 403 |
| 30.2 | — | 435 |
| 31.2 | — | 451 |

[1]Shear strength for 49.5 $cm^2$ surface area, −4 mesh particle size.

Table II represents test results for untreated coal and for coal treated with ammonium dodecyl benzene sulfonate (Cycloryl SZA) in various forms ("manual" means mixing of the coal with the active substance by agitation) and at varying moisture contents of the coal. The last column is an indication of the diminution in shear strength of the treated coal as compared to the untreated coal and dry coal, and is a measure of the improvement in flow characteristic with respect to the untreated wet coal. The treatment rates for all of the treated samples represent percent by weight of the active substance with respect to the weight of the wet coal, and are essentially the same for all of the samples. The foam was applied to free-falling coal using a laboratory scale foaming device and was delivered as a 1.76% actives solution in water at a rate of approximately 46.5 ml/min., this resulting in an application of approximately 0.0138 grams per second of active material.

TABLE II

COMPARISON OF ADDITIVE APPLICATION TECHNIQUES[1]

| Run | Treatment Rate, %[2] | Application Technique | % Moisture[3] | Avg. Shear, g[4] | Δ Shear, %[5] |
|---|---|---|---|---|---|
| base-line | — | — | 6.9 | 417 | — |
| base-line | — | — | 7.1 | 420 | — |
| base-line | — | — | 8.1 | 438 | — |
| 1 | 0.017 | manual | 6.9 | 382 | −25.2 |
| 2 | 0.018 | foam | 8.1 | 368 | −44.1 |
| 3 | 0.017 | foam | 7.1 | 365 | −39.1 |
| 4 | 0.017 | foam | 6.9 | 353 | −46.1 |
| 5 | 0.019 | spray | 6.9 | 402 | −11.4 |
| 6 | 0.020 | spray | 6.9 | 406 | −8.4 |

[1]bituminous coal, minus 4 mesh
[2]ammonium dodecyl benzene sulfonate
[3]total moisture
[4]shear strength for a 49.5 $cm^2$ test surface $$^{(5)}\Delta \text{ shear} = \left[\frac{\text{treated shear} - \text{wet shear}}{\text{wet shear} - \text{dry shear}}\right] \times 100$$

dry shear = 278.5 g

It will be seen from Table II that applying the active material in the form of a foam produced twice the flow improvement as manual mixing of the active material and four to five times as much flow improvement as aqueous spray application.

Table III represents a compilation of laboratory testing results on bituminous and lignite coal particles of various surfactants, some anionic, some cationic and some non-ionic. In all cases in connection with bituminous coal, and in most cases in connection with lignite coal, the application of the surfactants in foamed form resulted in an improvement, and usually a quite significant improvement, in wet flow characteristics, as indicated in the last column in which, as in Table II, negative values of shear change mean that shear occurs at lower forces, thus indicating improved flow.

TABLE II

WET COAL FLOW AID SUMMARY

| TRADENAME | CHEMICAL NAME | COAL TYPE | % MOISTURE | FLOW EVALUATION TREAT RATE, % | AVG. SHEAR, g | Δ SHEAR %[2] |
|---|---|---|---|---|---|---|
| Petro AG Special - A[1] | sodium mono and | Bituminous | 7.4 | 0.017 | 412 | −9.6 |

TABLE II-continued

| WET COAL FLOW AID SUMMARY | | | | | | |
|---|---|---|---|---|---|---|
| | | FLOW EVALUATION | | | | |
| TRADENAME | CHEMICAL NAME | COAL TYPE | % MOISTURE | TREAT RATE, % | AVG. SHEAR, g | Δ SHEAR %(2) |
| | dimethyl naphthalene | | | 0.034 | 368 | −39.4 |
| | sulfonate(3) | Lignite | 30.2 | 0.017 | 409 | −14.8 |
| | | | 24.9 | 0.034 | 343 | −8.6 |
| | | | 30.2 | 0.034 | 429 | −3.6 |
| | | | 31.2 | 0.034 | 447 | −2.0 |
| Tergitol 15-S-7 - N(1) | POE [7] fatty alcohol(4) | Bituminous | 7.4 | 0.017 | 409 | −11.4 |
| | | Lignite | 30.2 | 0.017 | 421 | −7.9 |
| Cycloryl SZA - A | ammonium dodecyl | Bituminous | 7.4 | 0.017 | 359 | −45.6 |
| | benzene sulfonate(3) | Lignite | 30.2 | 0.017 | 390 | −25.4 |
| | | | 30.2 | 0.034 | 384 | −28.6 |
| Stepasol CA 207 - A | ammonium salt of | Bituminous | 7.4 | 0.017 | 389 | −12.4 |
| | fatty alcohol | Lignite | 31.2 | 0.017 | 411 | −20.7 |
| | ether sulfate(5) | | | | | |
| Steol KS 460 - A | sodium laureth | Bituminous | 7.4 | 0.017 | 365 | −41.1 |
| | sulfate(5) | | | | | |
| Bio Terge AS-40 - A | sodium salt of $C_{14}$–$C_{16}$ | Bituminous | 7.4 | 0.017 | 397 | −19.9 |
| | alpha olefin sulfonate(6) | | | | | |
| — A | sodium lauryl sulfate(7) | Bituminous | 7.4 | 0.034 | 370 | −38.3 |
| Ninol 4821 - N | diethanolamine | Bituminous | 7.4 | 0.017 | 407 | −12.7 |
| | lauramide(8) | | | | | |
| Emerest 2630 - N | POE [6.8] lauric acid(9) | Lignite | 30.2 | 0.017 | 404 | −17.6 |
| Trydet OA5 - N | POE [5] oleic acid(9) | Lignite | 30.2 | 0.034 | 421 | −7.9 |
| Trymeen TAM15 - C(1) | POE [15] tallow amine(10) | Lignite | 30.2 | 0.017 | 418 | −9.8 |
| | | | 30.2 | 0.034 | 409 | −14.7 |
| Emsorb 2515 - N | sorbitan monolaurate(11) | Lignite | 30.2 | 0.034 | 400 | −19.8 |
| Emsorb 6916 - N | POE [4] sorbitan | Bituminous | 7.4 | 0.017 | 404 | −15.3 |
| | monolaurate(12) | Lignite | 28.2 | 0.034 | 439 | +24.4 |
| Bio Surf PBC 460 - N | $C_{12}$–$C_{14}$ dimethylamine | Bituminous | 7.4 | 0.017 | 397 | −19.9 |
| | oxide(13) | Lignite | 24.9 | 0.034 | 419 | +73.6 |
| Hamposyl L30 - A | sodium lauroyl | Bituminous | 7.4 | 0.017 | 380 | −31.1 |
| | sarcosinate(14) | Lignite | 24.9 | 0.034 | 430 | +85.8 |

Footnotes (1)A = anionic surfactant, N = nonionic, C = cationic (2)$\Delta \text{ Shear} = \left[\frac{\text{Treated shear} - \text{Wet shear}}{\text{Wet shear} - \text{Dry shear}}\right] \cdot 100$ (3)Surfactant class: salts of alkylaryl sulfonates
(4)Surfactant class: ethoxylated fatty alcohols
(5)Surfactant class: salts of alkoxylated fatty alcohol sulfates
(6)Surfactant class: salts of fatty alpha olefin sulfonates
(7)Surfactant class: salts of fatty alcohol sulfates
(8)Surfactant class: fatty acid amides of ethanolamines
(9)Surfactant class: ethoxylated fatty acids
(10)Surfactant class: ethoxylated fatty amines
(11)Surfactant class: sorbitan esters
(12)Surfactant class: ethoxylated sorbitan esters
(13)Surfactant class: fatty tertiary amine oxides
(14)Surfactant class: salts of N-fatty acylamino acids Field tests have confirmed the advantageousness of applying the surfactant in a foamed condition. A particular commercial electricity generating station had been experiencing wet coal blockages at moisture levels of 8.2–12.3%. Attempts to cure that blockage by applying Petro AG as a spray of a 16% solution of that substance at an application rate of 5 pints of the Petro AG per ton of coal were essentially unsuccessful. (Petro AG is one of the wet flow improving agents disclosed and claimed in my U.S. Pat. No. 4,432,797.) The field test for the application of foam was conducted by using two silos, both feeding an operating furnace. Coal with a particular moisture content was supplied to both silos, and in one silo Cycloryl SZA (ammonium dodecyl benzene sulfonate) was applied to the coal in the form of a foam. The first silo, containing only the moist coal, will be called the "control silo" and the other silo, containing the moist coal with foamed additive, will be called the "treatment silo".

When the control silo alone was operative at a coal moisture range of 8.8–9.25% plugging occurred. The moisture content of the coal in both silos was raised to 9.6% and the foam in the treatment silo was applied at a rate of from 0.011–0.015% by weight of surfactant to coal. No blockages occurred in either silo during one day's operation. On the following day the coal moisture level for both silos was increased to 9.8–10.5% and the rate of application of the foamed surfactant was the same as before. During a day's operation the control silo plugged three times but no problems were encountered with the treatment silo. The following day the coal surface moisture was increased to 10.5–10.9% and the rate of application of the foamed surfactant was increased to 0.017–0.018% by weight. Within a few hours there was a blockage of the control silo and inspection showed that wet, fine coal was closing the throat. There were no blockages of the treatment silo. The test had to be interrupted after an hour for extraneous reasons. On the next day the moisture range was raised to 11.9–12.3% and the foamed surfactant was applied at a rate of 0.021% by weight. It was observed that the treatment silo was emptying much faster than the control silo, and in the middle of the afternoon the control silo was inspected. It was plugged about 90% with a rathole only 2 inches in diameter in the middle of the downcomer. Inspection of the treatment silo showed no problem. The control silo was cleared and the test continued. That afternoon the control silo plugged two more times but the treatment silo fed coal at normal capacity for full load conditions without any problem. The following day the moisture level of the coal was increased to 12.7–13% and the rate of application of the foamed surfactant was increased to 0.027%. Neither silo plugged that day, but it was observed that the treatment silo was providing almost all of the coal to the furnace. That concluded the test. The treatment rates of the foamed surfactant amounted to about 1–3 pints of 16% active surfactant per ton, which produced excellent results in reducing blockages, whereas, as has been pointed out, a treatment rate of 5 pints per ton of a known wet flow improving agent (16% actives) applied in spray form produced no significant results.

As is shown in Table III, not all surfactants have the same advantageous effect in improving wet flow, nor do they necessarily have the same effect on bituminous coal and lignite coal. There apparently is no necessary direct relationship between the foamability of the surfactant and its effectiveness as a wet coal flow aid. Of the surfactants listed in Table III, Cycloryl SZA, Stepasol CA-207, Steol KS 460, Bio Terge AS-40, sodium lauryl sulfate, Bio Surf PBC-460 and Hamposyl L 30 are known to be good foamers. Petro AG Special, Tergitol 15-S-7 and Ninol 4821 are low to moderate foamers. The remaining examples in Table III are poor foamers or non-foamers. Indeed, Emsorb 2515, which is one of the more effective materials that we have found for foamed application to lignite coal, is described in the product literature as having anti-foam properties, and in order to use Emsorb 2515 in the method here disclosed it must be combined with a good foaming agent. As has been noted, some substances which markedly improve the wet flow characteristics of bituminous coal are actually deleterious to the wet flow characteristics of lignite coal. The reasons for the apparent anomalies are not known. Every surfactant that has been tested to date, when applied in foamed condition, has improved the wet flow characteristics of bituminous coal.

The relationship between treatment rate and improvement in wet flow, and between treatment rate and the moisture content of the coal, is not uniform, at least in the laboratory tests that have been carried out, as indicated in Table III.

The fact that the specific compounds tested do not foam well does not exclude the possibility that other compounds in the same class will foam well and retain their flow-improving properties. The water solubility of the ethoxylated derivatives can be varied readily by changing the degree of ethoxylation. Many such variations are commercially available.

The foaming process useful in this application is not critical, but can be broadly characterized for practical purposes by specifying the concentration of surfactant, expansion ratio, and bubble size. The objective of the foam application is to obtain the benefits of foam without adding an excessive amount of water. The concentration of surfactant in the foaming solution should be in the broad range of 1–50%. Expansion ratios (i.e. ratio of final foam volume to volume of foaming solution) are in the range of 10:1 to 100:1, with 20:1 to 30:1 being typical. Bubble size and stability are not critical, but foam with bubble diameters greater than 1–2 mm indicates unacceptably poor foaming characteristics.

All laboratory shear tests were conducted on −4 mesh coal (less than 0.19 inch diameter) to ensure reproducible results. Pluggage problems in the field are usually associated with the transfer of crushed coal from hoppers. There is no specific definition of crushed coal, but the size range can be approximated as −0.5 inch diameter, meaning all sizes from dust up to a maximum of 0.5 inch. Suitable application ranges for flow improvement on this size coal are: 0.004–0.07% overall, 0.01–0.06% preferred, and 0.015–0.05% typical, all representing proportions by weight of surfactant compared with wet coal.

From the above it will be seen that the application in a foamed condition of the surfactants or other substances known to have the property of improving the flow characteristics of wet, water-insoluble particles greatly improves the wet flow characteristics of the coal or other water-insoluble particles and at the same time requires the use of the non-aqueous component in relatively smaller amounts than are required to produce lesser improvement in the wet flow characteristics through the application of non-foamed substances. Thus a double improvement is achieved—better flow at lesser cost.

While but a limited number of embodiments of the present invention have been here specifically disclosed, it will be apparent that many variations may be made herein, all within the scope of the invention as defined in the following claims.

I claim:

1. The method of improving the flow characteristics of a mass of wet, water-insoluble solid particles having a size of approximately 4 mesh or larger which comprises (a) applying to said particles a foam of a substance having the property of improving the flow characteristics of said particles when applied in a non-foamed condition, said substance being selected from the group consisting of methyl and dimethyl napthalene sulfonates and ethoxylated linear secondary ($C_{11}$–$C_{15}$) alcohols, said water solution having a low viscosity, a high flash point and low toxicity, and (b) causing said mass of particles to flow from one location to another, whereby caking tendencies of the wet particles are inhibited, and freedom of flow of said particles between said locations is enhanced to a substantially greater degree than if said substance had not been applied as a foam.

2. The method of claim 1, in which said water-insoluble solid particles comprise coal particles.

3. The method of any one of claims 1–2, in which said substance is applied to said particles in an amount between 0.004–0.07% by weight of said particles.

4. The method of any one of claims 1–2, in which said substance is applied to said particles in an amount between 0.01–0.06% by weight of said particles.

5. The method of any one of claims 1–2, in which said substance is applied to said particles in an amount between 0.015–0.05% by weight of said particles.

6. The method of claim 2, in which said substance is applied to said particles in amounts corresponding to one pound or more of said substance per ton of particles.

7. The method of improving the flow characteristics of a mass of wet, small, water-insoluble particles which comprises (a) forming on said particles a surface coating of a fluid comprising a substance having the property of lowering surface tension in aqueous solution by applying said fluid to said particles in the form of a foam, said substance being present in an amount of one pound or less per ton of particles, said substance being selected from the group consisting of methyl and dimethyl naphthalene sulfonates and ethoxylated linear secondary ($C_{11}$–$C_{15}$) alcohols, said water solution having a low viscosity, a high flash point and low toxicity, and (b) causing said mass of particles to flow from one location to another, whereby caking tendencies of the wet particles are inhibited, and freedom of flow of said particles between said locations is enhanced to a greater degree than if said substance had not been applied in the form of a foam.

8. The method of claim 7, in which said water-insoluble particles comprise coal particles.

9. The method of either of claims 7 or 8, in which the particles are 4 mesh size or larger.

10. The method of any one of claims 7–9, in which said surfactant is an aqueous solution in a concentration of between 1–50% by weight of said solution.

11. The method of any one of claims 7–10, in which said surfactant is in aqueous solution in a concentration of between 2–25% by weight of said solution.

12. The method of any one of claims 7–10, in which said surfactant is in aqueous solution in a concentration of between 5–10% by weight of said solution.

13. The method of any one of claims 7–10, in which said surfactant is applied to said particles in an amount between 0.004–0.07% by weight of said particles.

14. The method of any one of claims 7–10, in which said surfactant is applied to said particles in an amount between 0.01–0.06% by weight of said particles.

15. The method of any one of claims 7–10, in which said surfactant is applied to said particles in an amount between 0.015–0.05% by weight of said particles.

* * * * *